US007667650B2

(12) United States Patent
Tiezzi et al.

(10) Patent No.: US 7,667,650 B2
(45) Date of Patent: Feb. 23, 2010

(54) PLANAR ANTENNA FOR MOBILE SATELLITE APPLICATIONS

(75) Inventors: Ferdinando Tiezzi, Renens (CH); Stefano Vaccaro, Gland (CH)

(73) Assignee: Viasat, Inc., Carlsbad, CA (US)

( * ) Notice: Subject to any disclaimer, the term of this patent is extended or adjusted under 35 U.S.C. 154(b) by 28 days.

(21) Appl. No.: 11/575,654

(22) PCT Filed: Sep. 24, 2004

(86) PCT No.: PCT/EP2004/052312

§ 371 (c)(1),
(2), (4) Date: Jul. 9, 2008

(87) PCT Pub. No.: WO2006/032305

PCT Pub. Date: Mar. 30, 2006

(65) Prior Publication Data

US 2008/0266178 A1 Oct. 30, 2008

(51) Int. Cl.
*H01Q 1/38* (2006.01)

(52) U.S. Cl. ..... 343/700 MS; 343/769

(58) Field of Classification Search ..... 343/700 MS, 343/769, 846

See application file for complete search history.

(56) References Cited

U.S. PATENT DOCUMENTS

| | | | | |
|---|---|---|---|---|
| 4,843,400 | A | 6/1989 | Tsao et al. | |
| 5,165,109 | A | 11/1992 | Han et al. | |
| 5,548,297 | A | 8/1996 | Arai | |
| 6,597,316 | B2 * | 7/2003 | Rao et al. | 343/700 MS |
| 6,930,639 | B2 * | 8/2005 | Bauregger et al. | 343/700 MS |
| 2003/0210193 | A1 | 11/2003 | Rossman et al. | |
| 2004/0051675 | A1 | 3/2004 | Inoue | |

FOREIGN PATENT DOCUMENTS

| | | |
|---|---|---|
| EP | 0 521 377 A2 | 1/1993 |
| EP | 1 239 542 A1 | 9/2002 |

OTHER PUBLICATIONS

Chiou, Tzung-Wern et al., "A Compact Dual-Band Dual-Polarized Patch Antenna for 900/1800-MHz Cellular Systems," IEEE Transactions on Antennas and Propagation, vol. 51, No. 8, Aug. 8, 2003, pp. 1936-1940.

(Continued)

*Primary Examiner*—Michael C Wimer

(57) ABSTRACT

The invention relates to a microstrip patch antenna (1) for mobile satellite communications comprising a first electrically conducting ground plane (4) having at least one opening (7), at least one patch radiating element (2), at least one first dielectric layer (L2) disposed between the first electrically conducting ground plane and the patch radiating element and more particularly between the at least one opening and the patch radiating element, at least one feed line (6) for providing signal energy in a contactless manner to or from the patch radiating element through the opening and a second dielectric layer (L3) disposed between the feed line and the first electrically conducting ground plane wherein the antenna further comprises a second ground plane (8) and a third dielectric layer (L4) disposed between the second ground plane and the feed line.

23 Claims, 5 Drawing Sheets

OTHER PUBLICATIONS

Huang, John, "Circularly Polarized Conical Patterns from Circular Microstrip Antennas," IEEE Transactions on Antennas and Propagation, vol. AP-32, No. 9, Sep. 1984, pp. 991-994.
Zhang, W.X. et al., "The Aperture-coupled U-slotted Patch Antenna," IEEE, 1999, pp. 2782-2785.
Bhattacharyya, Arun et al., "Analysis of Stripline-Fed Slot-Coupled Patch Antennas with Vias for Parallel-Plate Mode Suppression," IEEE Transactions on Antennas and Propagation, vol. 46, No. 4, Apr. 1998, pp. 538-545.
Batchelor, J.C. et al., "Microstrip ring antennas operating at higher order modes for mobile communications," IEE Proc.-Microw. Antennas Propag., vol. 142, No. 2, Apr. 1995, pp. 151-155.
International Search Report issued in corresponding application No. PCT/EP2004/052312, completed Nov. 12, 2004 and mailed Nov. 26, 2004.
Search Report and Written Opinion issued by the Austrian Patent Office in the correspondence Singapore application No. 200702204-9, completed Mar. 20, 2008.

* cited by examiner

PLANAR ANTENNA FOR MOBILE SATELLITE APPLICATIONS

This is a National Phase Application in the United States of International Patent Application No. PCT/EP2004/052312 filed Sep. 24, 2004, the entire disclosure of which is hereby incorporated by reference.

FIELD OF THE INVENTION

The invention relates generally to an antenna for vehicular mobile applications using mobile satellite systems, and more particularly, to a microstrip fed annular patch antenna with a conical radiation pattern with high directivity in the range of low elevation angle above the horizon. This kind of antenna is generally designed to be a car-top antenna for satellite communications. The invention also relates to a multi-system antenna.

BACKGROUND OF THE INVENTION

In recent years, many new satellite based services for vehicular (cars, airplanes . . . ) have come into service. These services include many applications such as satellite communications or global positioning systems. Compact antennas, generally arranged on the top of the vehicle, are required to receive these kinds of services together with traffic and emergency or security information data. These services are not only likely to be operated at different frequencies but also the radiation pattern requirements from the antenna will be different. For example, telecommunications may be provided via geostationary satellite system requiring antenna beams pointing at elevation between 20° and 60° at European latitudes while global positioning system requires antenna beams at zenith elevation.

The development of effective vehicular front-ends requires antennas with high directivity in the desired elevation angle, flat profile, lightweight, low-cost, and preferably conformable on curved surfaces.

A solution consisting in using an omnidirectional antenna should not be envisaged due to low gain. Another solution consisting in using a phase array for tracking satellites should also not be envisaged as being too expensive for standard consumer terminals. Printed antennas are incontestably the best suited kind of antennas for the development of such front-ends circuits of an antenna for vehicular mobile applications.

The requirements for user terminal antennas are tightly dependent on the associated space segment. Several existing and foreseen services will be based on geostationary space segment, which requires user segment antennas with intermediate gain (2-3 to 6-7 dBi). Typical user segment antennas for such applications can be subdivided in two main subsets: low and high latitudes. Low latitudes applications require antenna with a wide beam pointing in the vertical direction and their design does not present particular difficulties. At high latitudes, geostationary satellites are seen at an elevation angle between 66° down to 22°. In this case, user antennas for mobile applications must have the maximum directivity at an elevation angle of approximately 45° and they must be omnidirectional in azimuth. In other words, these user antennas must have a conical radiation pattern.

Printed antennas generating a conical radiation pattern are very interesting for the design of flat user terminal antennas for mobile satellite systems. Circular and annular patches resonating at higher modes are typical candidates to obtain such radiation patterns.

A prior art solution is disclosed in the U.S. Patent Application No. 2003/0210193. This document relates to a low-profile disk-shaped two-antenna assembly 100, shown on FIG. 11, including a first circular polarization ring antenna and a second linear monopole antenna that is located concentrically within the ring antenna. The antenna assembly 100 occupies then a cylindrical volume having a central axis.

The ring antenna comprises a metal resonant ring 101 tuned for the second-order mode ($TM_{21}$) of operation, which is fed by a metal feed post 103 and its series-connected capacitor 104. The ring antenna is dielectrically loaded to reduce its physical size by positioning a low-dielectric plastic or dielectric ring 107 under resonant ring 101. The monopole antenna comprises two metal posts 105 spaced on opposite sides of the central axis and supporting at their top end a metal disk 106. Mechanical support for feed post 103, metal monopole posts 105 and for a metal ground plane 109 is provided by a PCB 108.

Both the ring antenna and the monopole antenna radiate in a conical radiation pattern, with the axis of the conical pattern extending generally perpendicular to the planar top surface of the antenna assembly 100 that contains both metal resonant ring 101 and metal disk 106.

However, U.S. Patent Application No. 2003/0210193 presents some drawbacks. Firstly, as it has been mentioned before, one of the most important requirement for user terminal antennas for mobile satellite communications is an antenna having a conical radiation pattern in the desired elevation angle, i.e. for instance between 20° and 60°, centered in the desired zone, for instance about 40-45°. In the antenna assembly presented in U.S. Patent Application No. 2003/0210193, both the ring antenna and the monopole antenna are excited via metal feed posts 103 and 105 which extend between the ground plane 109 and the corresponding radiating element 101 and 106.

It has been shown within the scope of the present invention, that such metallic feeding posts introduce perturbation into the conical radiation pattern. The resulting pattern is less homogenous than the theorical expected one and moreover the radiation amplitude is reduced. Therefore, the resulting antenna is less efficient.

Furthermore, with the goal of incorporating such an antenna assembly in a car-top application, the behaviour of this antenna assembly will be greatly influenced by the car-top material depending on whether it is glass, metal or plastic and also by the car-top design depending on whether it is plane, curved or with any fancy shape. Because the antenna disclosed in U.S. Patent Application No. 2003/0210193 is ground-plane dependent, the antenna radiation pattern has to be adjusted by using a metal pedestal.

SUMMARY OF THE INVENTION

The main objects of the present invention are to overcome afore cited drawbacks by providing an antenna assembly with low-profile which can be arranged very close or even in contact to any kind of mobile support and which has a homogenous conical radiation pattern with a satisfactory efficiency.

In order to achieve the above mentioned objects, the present invention concerns an antenna assembly such as a microstrip patch antenna (1) for mobile satellite communications that includes a first electrically conducting ground plane (4) having at least one opening (7; 10), at least one patch radiating element (2), at least one first dielectric layer (L2; L21-L22; L21-L23; L21-L25) disposed between the first electrically conducting ground plane and the patch radiating element and more particularly between the at least one opening and the patch radiating element, at least one feed line (6) for providing signal energy in a contactless manner to or from the patch radiating element through the opening and a second dielectric layer (L3) disposed between the feed line and the first electrically conducting ground plane wherein the antenna further comprises a second ground plane (8) and a third dielectric layer (L4) disposed between the second ground plane and the feed line. Accordingly, a more homogenous conical radiation pattern is obtained with the feed line that provides signal energy in a contact less manner to or from the patch radiating element through the opening. Nevertheless, contact less coupling impedes use of a metal pedestal connecting with the first electrically ground plane. Therefore, it is further provided with the arrangement of an additional foam or air layer together with a second ground plane which strongly reduces influences due to the vehicle support on which the antenna assembly is embedded and also allows reducing the minimum required distance between the vehicle and the antenna assembly.

Others advantageous features are considered in the other embodiments described herein and as recited in the claims. For instance, the use of specific dielectric layers allows an optimized radiation at low elevation angles and further reduces the size of the antenna. Further by using a feed line slot coupled to the patch radiating element, the antenna bandwidth is increased in comparison with excitation by feeding post according to the prior art solution. Furthermore, by using a particular slot disposition arrangement the circular polarization is particularly efficient.

Another object of the present invention relates to a flat multifunctional antenna system for vehicular terminals able to satisfy simultaneously the requirements of several mobile satellite system applications.

In order to achieve this other object, the present invention also concerns a multi-system antenna assembly such as a multi-system antenna (21) for mobile communications that includes a first electrically conducting ground plane having at least first (27) and second (36, 37) openings; an annular patch radiating element (22) and a circular patch radiating element (33) concentrically arranged and coplanar with respect to the annular patch radiating element; at least one first dielectric layer disposed between the electrically conducting ground plane and the annular and circular patch radiating elements and more particularly between the first and second openings and the annular and circular patch radiating elements; at least first (26) and second (38) feed lines for providing signal energy in a contactless manner to or from the annular and circular patch radiating elements respectively through the first and second openings; and a second dielectric layer disposed between the first and second feed lines and the electrically conducting ground plane. The idea consists in particular to use the space left by the central part and/or the external periphery of the ring to integrate additional elements and hence access different systems without any increase in size and production cost.

Advantageous features of this multi-system antenna assembly are given with dependent claims.

BRIEF DESCRIPTION OF THE DRAWINGS

The foregoing and additional objects, features and advantages of the present invention will be more readily apparent from the following detailed description of a preferred embodiment, as illustrated in the accompanying drawings, in which.

DETAILED DESCRIPTION OF PREFERRED EMBODIMENTS

First of all, it is to note that the Figures are given only for an illustration purpose of the several embodiments which will be described hereinafter and that the cross-section views of the different antenna assemblies are divided into different layers which are not necessarily represented with a same scale within a same Figure.

In the following embodiments, the antenna assembly is a microstrip patch antenna for mobile satellite communications resonating preferentially at second-order mode ($TM_{21}$) which resulting calculated radiation pattern is detailed in a publication entitled "Circularly polarized conical patterns from circular microstrip antennas" (IEEE Transactions and antennas propagation, vol. AP-32, No. p, September 1994) enclosed herewith by way of reference.

Figure 1A:
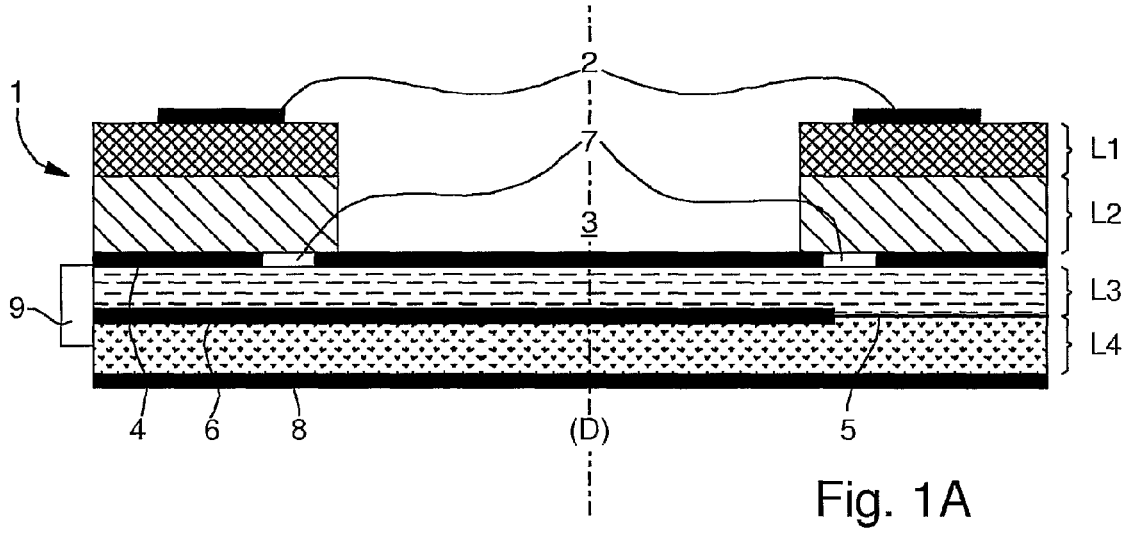
FIG. 1A is a cross section view of a simple antenna assembly according to a first embodiment of the present invention.

FIG. 1A is a cross section view of a simple antenna assembly according to a first embodiment of the present invention. In terms of structure, antenna assembly 1 preferably occupies a thin disk-shaped or cylindrical volume having a central axis (D) and a height which can be divided into successive layers each being circular or ring-shaped.

Departing from the top of FIG. 1A and going downwards, antenna assembly 1 comprises an annular patch radiating element 2, preferably printed or etched on an annular epoxy film forming a first layer L1 which secures patch radiating element 2 to the whole antenna assembly. Annular epoxy film L1 is glued on a first dielectric substrate layer L2 formed by a plastic material. Nevertheless, annular epoxy film L1 can be omitted and then patch radiating element 2 is directly glued on plastic layer L2. According to the represented embodiment on FIG. 1A, plastic layer L2 is ring-shaped, a disk-shaped void 3 being let in the middle. However as it will be described hereinafter in relation with FIGS. 9A-9B, this plastic layer L2 can have different shapes modifying its behaviour.

Under first dielectric layer L2, there is a second dielectric layer L3 advantageously made of polytetrafluoroethylene, generally called PTFE. This second dielectric layer L3 is metallised on both faces. Upper metallic face 4, separating first dielectric layer L2 from second dielectric layer L3, is used as a first electrically conducting ground plane 4 for antenna assembly 1, and lower metallic face 5 is used to support the microstrip circuit of the antenna comprising lines 6, couplers (not shown), active elements (also not shown), etc. . . . The different elements forming the microstrip circuit, which design depends on the specific desired application, are well known for those skilled in the art and therefore will not be detailed herewith. Both metallic faces 4 and respectively, 5 can then be used to etch simultaneously at least one opening 7, advantageously a slot, and respectively, the microstrip circuit having in particular at least one microstrip or feed line 6.

It is important to note that first dielectric layer L2 is arranged between opening 7 and patch radiating element 2 and that feeding line 6 provides signal energy in a contactless manner to or from patch radiating element 2 through opening 7.

The assembly above-described forms a microstrip patch antenna for mobile satellite communications, which is design to be advantageously arranged in a car-top application. However, it has been put into evidence within the present invention, that such an antenna assembly 1 is strongly influenced by the car-top material and shape. Indeed, the behaviour of such an antenna assembly arranged directly on a car-top will be strongly different whether the car-top material is metal, glass or plastic and whether the car-top shape is plane or curved. Thus, in order to guarantee a homogenous behaviour for a slot-coupled antenna assembly, it is then necessary to provide a space of at least 25 millimeters between the antenna and the car-top. Of course, such space requirement is unacceptable for car manufacturers. Therefore, in order to get rid of this space requirement between the antenna and the car-top, it is provided with a third dielectric layer L4, such as an air or a foam layer, under which is arranged a second ground plane 8 acting as a back shielding plate. Third dielectric layer L4 associated with second ground plane 8 enables to arrange the antenna assembly directly on the car-top or even embedded inside.

Figure 1B:
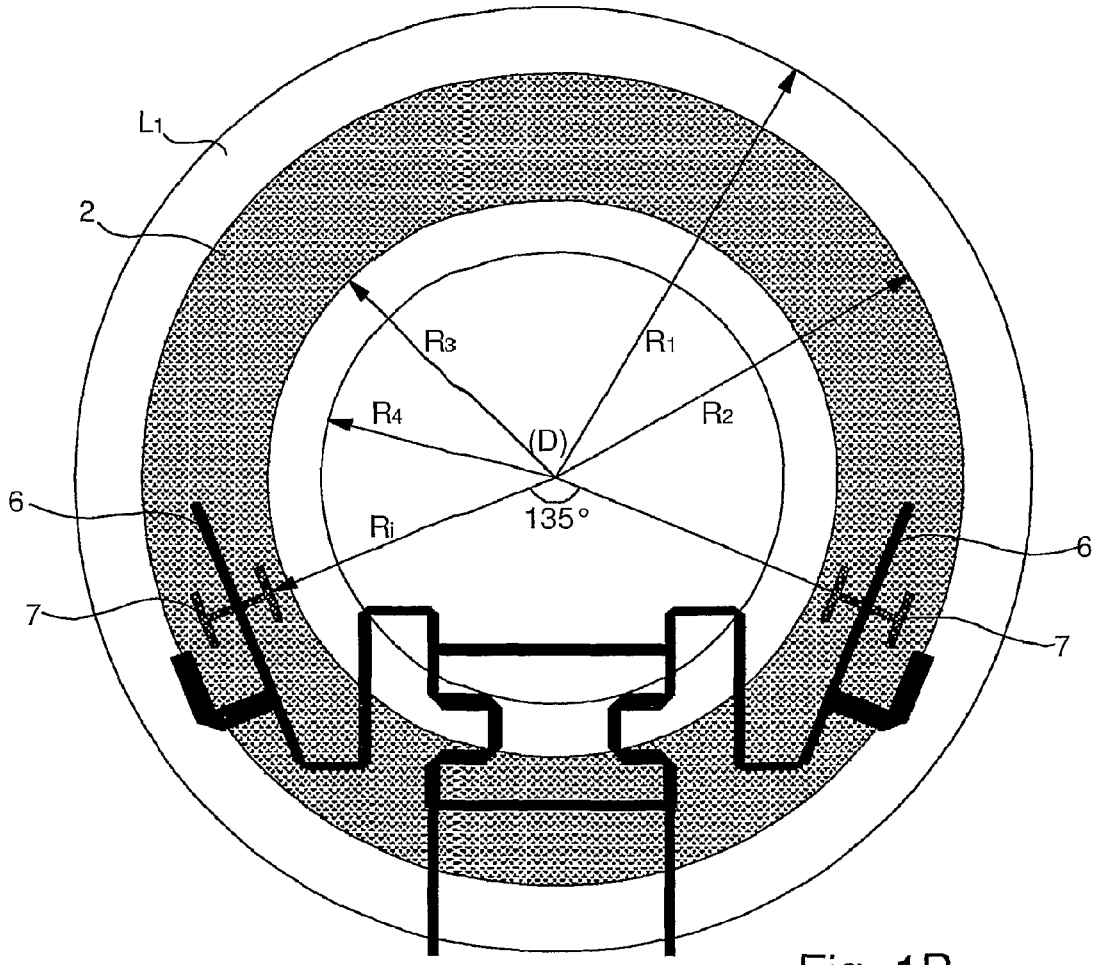
FIG. 1B is a schematic top view of the simple antenna assembly according to the first embodiment with its layout overprinted.

FIG. 1B is a top view of the simple antenna assembly according to the first embodiment shown on FIG. 1A. Only some layers of the antenna of FIG. 1A has been represented for sake of clarity.

We retrieve annular patch radiating element 2 which is supported by an epoxy film L1 arranged over first dielectric substrate L2 (not visible). As mentioned before, the first electrically conducting ground plane (not shown) has at least one opening 7 which is slot-shaped and which is at least partly facing annular patch radiating element 2. Thus at least one feed line 6 is slot-coupled to annular patch radiating element 2.

To obtain a dual circular polarisation (CP), i.e. both left and right circular polarisations, two excitations points positioned along the patch radiating element are needed, therefore the electrically conducting ground plane preferably comprises two slots 7 and below two microstrip lines 6 which are fed through a hybrid coupler. Slots 7 are angularly shifted so as to obtain both left and right circular polarisations. Advantageously slots 7 are positioned along annular patch 2 forming an angle of 135° with regard the central axis (D). But both circular polarisations can also be obtained by positioning the two excitation slots with an angle of 45°, nevertheless the resulting conical beam will be less homogeneous, i.e. it will present a ripple in the level of directivity along a conical cut of the radiation pattern. Furthermore, for the sake of optimizing the homogeneity of the radiation pattern in azimuth, the slots are preferably etched on a circular ground plane. It is to be noted that a four slots variant is also possible. The extra two slots are then arranged symmetrically with respect to the central axis (D).

Considering again FIG. 1A, to increase the bandwidth and the efficiency of the antenna a relatively thick dielectric layer L2 have to be used between annular patch radiating element 2 and electrically conducting ground plane 4. In this first embodiment, this layer L2 is composed by a plastic ring or eventually disk made, for example, of 6 mm of plastic. On this plastic layer, can be glued an epoxy film L1 where the patch has been printed or etched.

A long slot 7 is required to couple the energy from the microstrip line 6 to patch radiating element 2. The required size for a standard rectangular slot would be larger than the width of annular patch 2 that would increase the level of coupling between the excitation ports, i.e. the slots, and thus would decrease the circular polarisation quality.

Therefore to avoid this problem some special slots with folded arms have been designed. Preferably, each slot 7 is folded up to be fully facing annular patch radiating element 2. Some of the possible designs are shown on FIGS. 10A-10C.

Given below is an array with the height of the different layers (L1-L4) according to a preferred example of the above described first embodiment. Also given below are the dielectric constants (Dc), also called dielectric permittivity, of each layer.

| Layer | Material | Thickness (mm) | Dc |
|---|---|---|---|
| 1 | Epoxy | 0.1 | 4.4 |
| 2 | Plastic | 6 | 2.3 |
| 3 | PTFE | 0.5 | 2.49 |
| 4 | Foam (or air) | 5 | 1.05 |

According to this first particular example, the overall height or thickness of the antenna is very thin, but however the dielectric constant of the dielectric substrate, formed by layers L1 and L2, is greater than 2.

Radiuses $R_1$, $R_2$, $R_3$ and $R_4$, which are shown on FIG. 1B, correspond respectively to the outer radius of the ring dielectric layer ($R_1$), the outer radius of the annular patch ($R_2$), the inner radius of the annular patch ($R_3$), and the inner radius of the dielectric layer ($R_4$). Radius $R_i$ is the distance between the central axis and the middle point of the slots. Advantageously the diameter (corresponding to twice radius $R_2$) is slightly greater than half the wavelength of the desired application.

With respect to a similar design realised on a homogenous foam layer, the diameter size of the antenna can be reduced of about 30% and the thickness of about 60%. Thus, the main advantage of this first preferred example is the very thin resulting height of the antenna, although it may be slightly less efficient than the following solutions described hereinafter in relation with the second and third embodiments.

Figure 2:
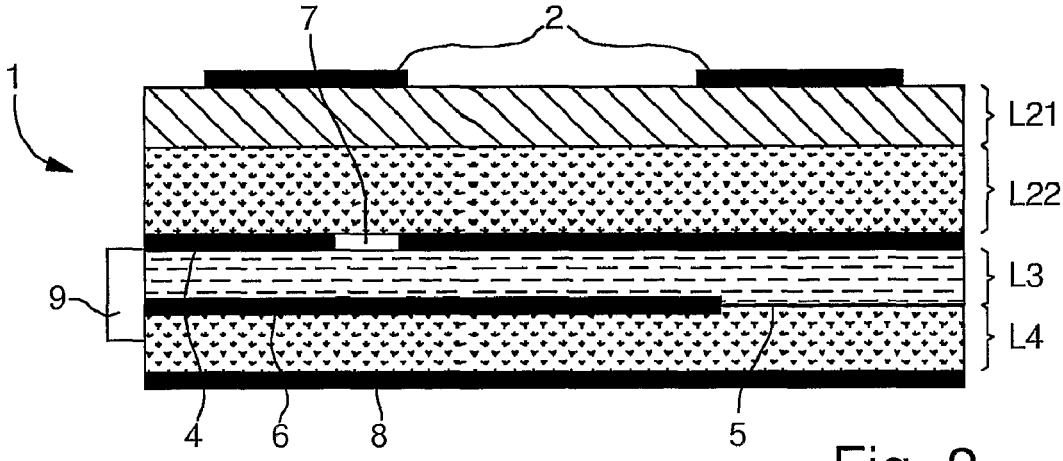
FIG. 2 is a cross section view of a simple antenna assembly according to a first variant of a second embodiment of the present invention.

FIG. 2 is a cross section view of a simple antenna assembly according to a first variant of a second embodiment of the present invention. All common elements with FIG. 1A will not be described in detail again.

The main difference between the previously described first embodiment and the second one relies on the dielectric substrate disposed between annular patch radiating element 2 and electrically conducting ground plane 4. In fact in the second embodiment, it is provided with a dielectric substrate based on sandwiched dielectric layers L21 and L22 composed of materials with different characteristics. The ad-hoc composition of dielectric layers L21 and L22 with different permittivity and thickness allows to synthesize the permittivity of the dielectric substrate between annular patch 2 and first ground plane 4, and therefore to optimise the size of the antenna and its performances.

Previous studies have shown that the use of high permitivitty substrates can be used not only to reduce the dimensions of such antennas but also to influence the inclination of the conical beam. The drawback of this approach is that the use of high permitivitty substrate can significantly reduce the antenna efficiency. An analysis of the radiation mechanisms of circular patches at higher order modes shows that the combination of dielectric losses together with a bad composition of the physical dimensions of the antenna with the free-space wavelength can result in antennas with very poor efficiency.

In the represented example, the dielectric substrate is formed by a first layer L21 of plastic and a second layer L22 of foam or air. Then the resulting dielectric constant of this dielectric substrate can be adjusted to the desired value. For instance, it has been shown within the scope of the present invention, a more efficient antenna for a dielectric constant of the dielectric substrate being between 1 and 2. With a plastic layer having a dielectric constant larger than 2, and a foam layer having a dielectric constant near from 1, dielectric constants of the dielectric substrate between 1 and 2 can be obtained in varying the height of dielectric layers L21 and L22.

Figure 3:
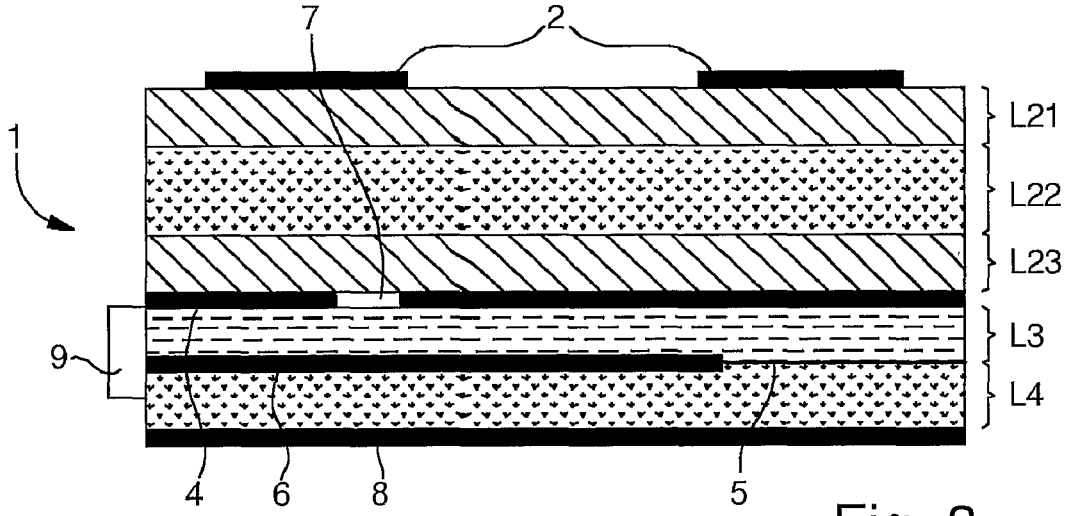
FIG. 3 is a cross section view of a simple antenna assembly according to a second variant of the second embodiment of the present invention.
Figure 4:
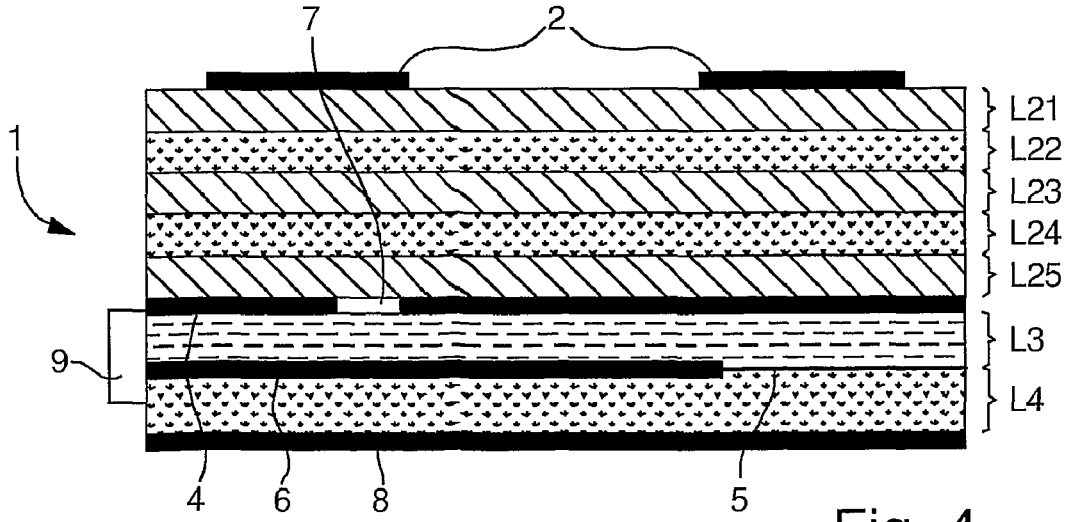
FIG. 4 is a cross section view of a simple antenna assembly according to a third variant of the second embodiment of the present invention.
Figure 5:
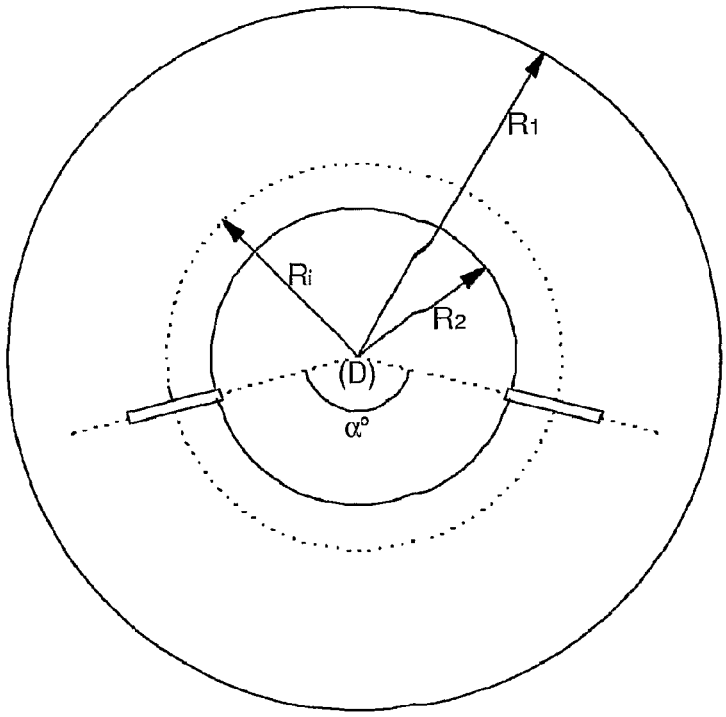
FIG. 5 is schematic top view of the arrangement of the slots towards the radiating element.

FIG. 5 is a schematic top view of FIGS. 2, 3 and 4 representing the slot arrangement towards the annular patch radiating element. As it can be seen on this view, the slots are arranged not right in the middle of the annular patch but are shifted to its inner periphery. The antenna matching may be adjusted by moving the slots along the annular patch. Nevertheless, it is important that both slots are kept with an angle of 135° in order to optimize reception of both circular polarisations.

Radiuses $R_1$ and $R_2$ correspond to the outer, respectively to the inner radius of the annular patch. Radius $R_i$ corresponds to the average radius of the slots with respect to the central axis (D). Advantageously, radius $R_2$ is slightly greater than a quarter of the desired wavelength.

FIG. 3 is a cross section view of a simple antenna assembly according to a second variant of the second embodiment of the present invention. As for FIG. 2, only new elements of this antenna assembly will be detailed hereinafter.

The main difference with the antenna assembly presented in relation with FIG. 2 is also the first dielectric substrate disposed between annular patch radiating element 2 and electrically conducting ground plane 4. In this second variant, the first dielectric substrate is composed by three layers (L21-L23). Between slots 7 (only one being shown) etched in ground plane 4 and annular patch 2, there is a sandwich of one layer of foam L22 disposed between two layers L21 and L23 of epoxy or plastic. In the presented example, the annular patch is directly etched on a layer of plastic L21, but it can also be etched on a thin epoxy film.

As well as for FIG. 2, the antenna efficiency is increased for a dielectric constant of the dielectric substrate (L21-L23) being between 1 and 2. Such a dielectric constant can be obtained in varying the height of dielectric layers L21, L22 and L23.

Given below is an array with the dimensions of the different layers (L21-L23 and L3-L4) according to a preferred example of the second variant. Also given below are the dielectric constants (Dc), also called dielectric permittivity, of each layer.

| Layer | Material | Thickness (mm) | Dc |
|---|---|---|---|
| 21 | Epoxy or Plastic | 0.8 to 5 | 4.4 or 2.3 |
| 22 | Foam (or air) | From 0.5 to 5 | 1.05 |
| 23 | Epoxy or Plastic | 0.8 to 5 | 4.4 or 2.3 |
| 3 | PTFE | 0.5 | 3.0 |
| 4 | Foam (or air) | 10 | 1.05 |

With respect to a similar design realised on a homogenous foam layer, the diameter size of the antenna can be reduced of about 20% and the thickness of about 45%. In particular, this multilayer dielectric substrate allows to optimize size reduction of the annular patch for low elevation angle and a wider radiation beam with respect to the previous one. An efficient experimental value for the dielectric constant is comprised between 1.7 and 1.9.

FIG. 4 is a cross section view of a simple antenna assembly according to a third variant of the second embodiment of the present invention. This third variant is still another variant of the first dielectric substrate disposed between annular patch radiating element 2 and electrically conducting ground plane 4. In this third variant, this dielectric substrate is provided with five layers (L21-L25) in order to obtain a dielectric substrate having an adjustable dielectric constant with the height of the different layers and whose behaviour is more homogenous in particular in term of radiation pattern. In the presented example, the annular patch is directly etched on a layer of plastic L21.

Thus, between slots 7 (only one being shown) in ground plane 4 and annular patch 2 there is a sandwich of three layers of plastic, L21, L23 and L25 and two layers of foam, L22 and L24. Each layer of foam is embedded between two layers of plastic. This composite dielectric substrate has been realized to further optimize the performances of the antenna and further reduce its size.

Given below is an array with the dimensions of the different layers (L21-L25 and L3-L4) according to a preferred example of the above described second variant. Also given below are the dielectric constants (Dc), also called dielectric permittivity, of each layer.

| Layer | Material | Thickness (mm) | Dc |
|---|---|---|---|
| 21 | Plastic | 1.8 | 2.3 |
| 22 | Foam (or air) | 1 | 1.05 |
| 23 | Plastic | 1.8 | 2.3 |
| 24 | Foam (or air) | 1 | 1.05 |
| 25 | Plastic | 0.8 | 2.3 |
| 3 | PTFE | 0.5 | 3 |
| 4 | Foam (or air) | 5 | 1.05 |

With respect to the latter solution described in relation with FIG. 3, the antenna diameter is about 10% smaller and its thickness is about 30% less. In particular this multilayer substrate allows having an annular patch size further optimized for low elevation angle and a wider radiation beam with respect to the previous one. An efficient experimental value for the dielectric constant is about 1.9.

Figure 6:
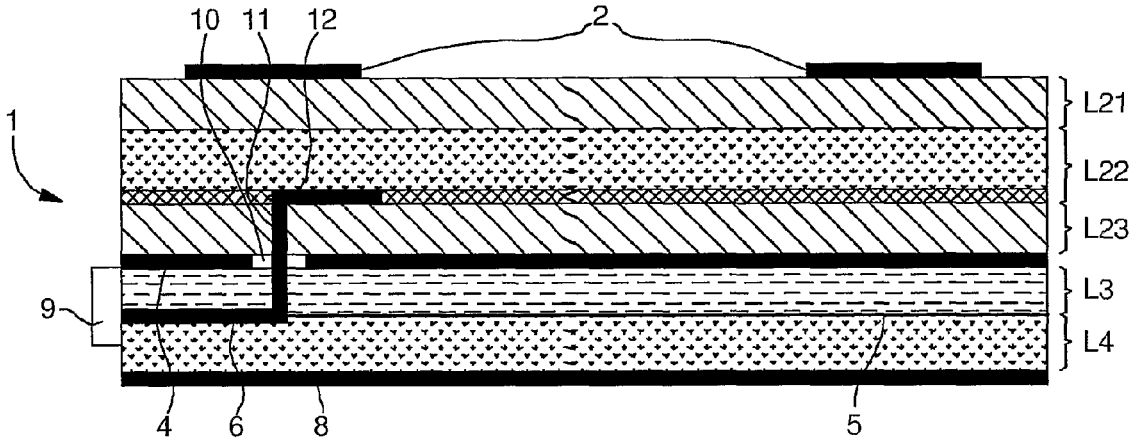
FIG. 6 is a cross section view of a simple antenna assembly according to a third embodiment of the present invention.

FIG. 6 is a cross section view of a simple antenna assembly according to a third embodiment of the present invention. In this third embodiment, the main difference with both first embodiments relies on the feeding means which are electromagnetically coupled to the annular patch instead of being slot-coupled.

Departing from the top of antenna assembly 1 and going downwards, we retrieve an annular patch radiating element 2, which is etched on a thin epoxy film (not shown, corresponding to L1 in the first embodiment) or directly on a plastic layer L21 of the first dielectric substrate. The first dielectric substrate comprises at least two layers (L21-L23). In the represented example, the dielectric substrate is formed by a sandwich of one epoxy or epoxy and foam layer L22 disposed between two layers of plastic L21 and L23. Under, the first dielectric substrate we retrieve the second dielectric substrate L3, advantageously formed by a layer of PTFE. This PTFE layer is metallised on both faces 4 and 5, and it is used to etch on the bottom side the microstrip circuit (feeding lines, coupler, active elements, etc.). On the top side, the metallization forms first electrically ground plane 4, in which at least one, and preferably two small circles 10 (only one shown) are etched to let passing through vertical metallic pins 11. Another feeding line 12 is etched in the intermediate epoxy layer L22 of the first dielectric substrate. Vertical metallic pins 11 are connected between feeding line 6 of the metallised bottom side of PTFE layer L3 and feeding line 12 embedded in the first dielectric substrate. Thus, the signal is electromagnetically coupled (no electric contact) between upper feeding line 12 and annular patch radiating element 2.

Finally under the bottom side metallization 5, a foam or air layer L4 is provided along with a second conducting ground plane 8 acting as a back shielding plate. The thickness and the diameter of this foam layer L4 can be reduced and consequently the overall size of the antenna can be also reduced. The efficiency of the antenna is then slightly decreased due to size reduction, but this loss is partially compensated by the fact that electromagnetic-coupled feeding is slightly more efficient than slot-coupled feeding. In contrast with the metallic feeding posts used in the prior art document U.S. 2003/0210193, the posts are here well shorter and then do not affect the radiation pattern of the antenna.

Given below is an array with the dimensions of the different layers (L1, L21-L23 and L3-L4) according to a preferred example of the above described third embodiment. Also given below are the dielectric constants (Dc), also called dielectric permittivity, of the different layers.

| Layer | Material | Thickness (mm) | Dc |
|---|---|---|---|
| L1 | Epoxy (optional layer) | 0.5 | 4.4 |
| L21 | Plastic only or Plastic + Epoxy | 0.8 to 5 | 2.3 |
| L22 | Epoxy + Foam or Epoxy only | 0.1 to 2-3 | 4.4 |
| L23 | Plastic | 0.8 to 5 | 2.3 |
| L3 | PTFE | 0.5 | 3 |
| L4 | Foam (or air) | 1 à 5 | 1.05 |

It is to be noted that electromagnetic-coupling is less influenced than slot-coupling by the support of the antenna (e.g. the car-top) and therefore the height of layer L4 could be further reduced.

Figure 7:
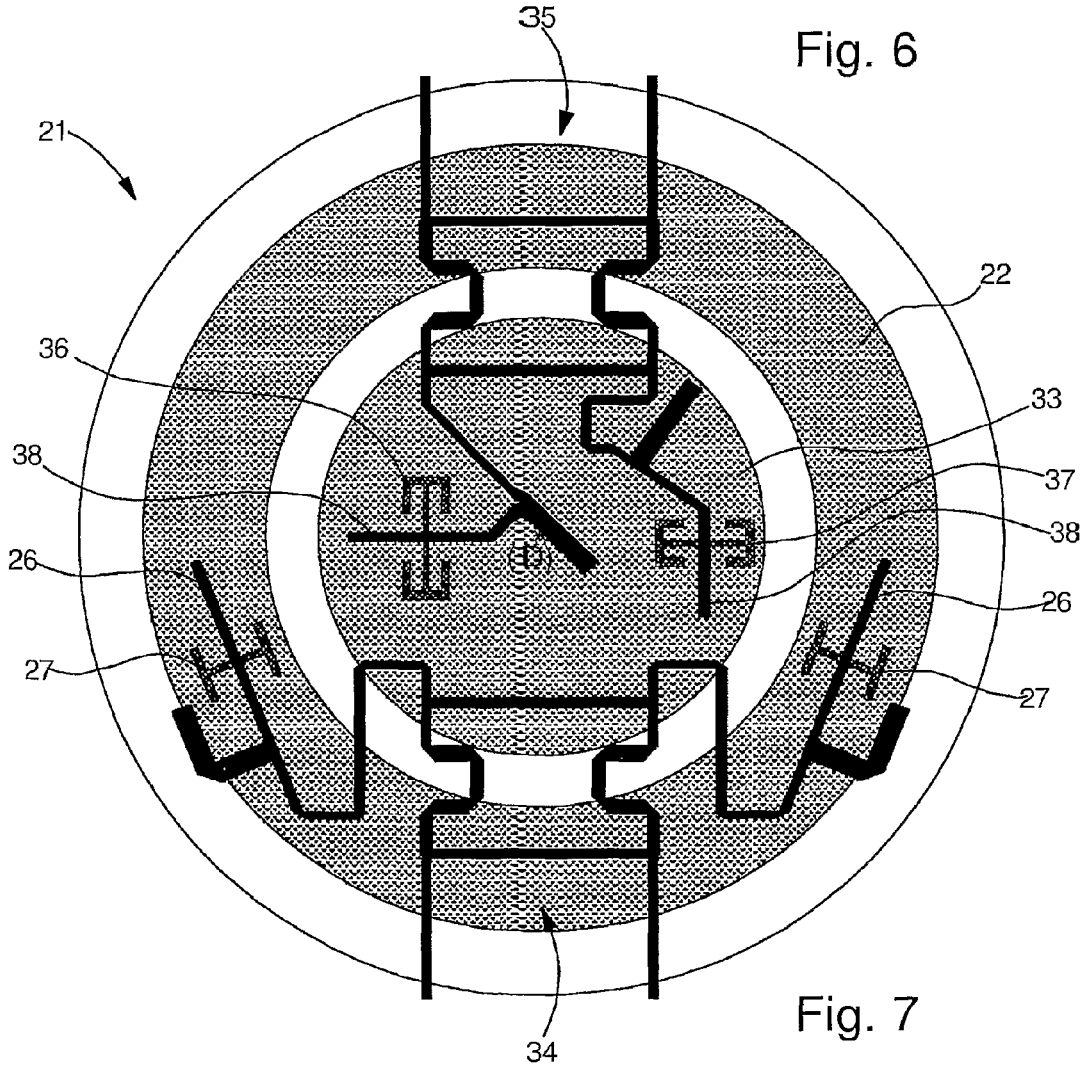
FIG. 7 is a top view of a first multi-system antenna assembly according to any of the preceding embodiments of the present invention.

FIG. 7 is a partial top view of a first multi-system antenna assembly 21 according to any of the preceding embodiments of the present invention. In this multi-system antenna, it is provided with antennas for at least two applications and preferably more than two. A very interesting feature is the overall size of such a multi-system antenna which is about the same size as the mono-application antenna structure described hereinbefore. It is therefore very suitable for mobile communication systems which always require more functionalities and less space to implement these latter.

In the represented example, the multi-system comprises a first antenna structure comprising an annular patch radiating element 22 slot-coupled, via slots 27, or electromagnetically-coupled (solution not shown on FIG. 7) to feeding lines 26. When used in the second-order resonant mode, this first antenna structure has a conical radiation pattern very useful and efficient for low elevation angle mobile satellite applications. It is reminded that the use of two slots 7 angularly shifted with an angle of 135° ensure a very efficient reception of both Right and Left Hand Circular Polarisations used by mobile satellite applications like WorldSpace.

In addition to this first antenna structure, multi-system antenna assembly 21 further comprises at least a second antenna structure for receiving signals from another application or eventually signals coming from repeaters of the first desired application.

For example, the second antenna structure comprises a disk patch radiating element 33 being concentrically disposed, i.e. within the inner radius of the annular patch, and preferably coplanar with respect to annular patch 22, in a plane perpendicular to central axis (D) and is advantageously designed on the same substrate structure of the annular patch. This circular patch radiating element 33 is resonating at the fundamental mode.

Simultaneously to the etching process of both metallization faces of the PTFE layer to obtain in particular microstrip circuit 34 of the first antenna (as described hereinbefore), a second antenna microstrip circuit 35 is etched on the bottom side metallization of the PTFE layer and an opening, for example a slot 36, is etched on the upper side metallization facing disk patch radiating element 33. Thus, circular patch radiating element 33 is also fed through slots 36, 37 in the ground plane and is also dual circularly polarised to work with both Right Hand Circular Polarisation (RHCP) used by navigation systems like the Global Positioning System (GPS) and the future Galileo system, and Left Hand Circular Polarisation (LHCP) used by bidirectional mobile communication system like THURAYA.

Figure 8:
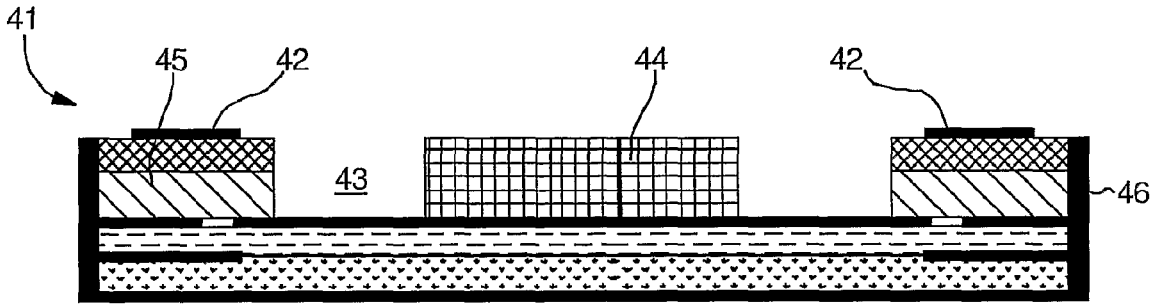
FIG. 8 is a cross section view of a second multi-system antenna assembly according to the first embodiment of the present invention.

FIG. 8 is a cross section of a second multi-system antenna assembly according to the first embodiment of the present invention. In this second multi-system antenna assembly 41, in addition to first antenna patch radiating element 42 already described in relation with FIGS. 1A and 1B, it is further provided with at least one another antenna. A miniaturized GPS antenna 44 can be incorporated in void space 43 inside first ring-shaped dielectric substrate 45. Advantageously a third antenna such as a radio FM antenna 46 is enrolled around the antenna assembly 41. Advantages of this solution are that both the GPS and the FM antennas are available at very low prices, and can be easily mounted on the microstrip patch antenna described in relation with the first embodiment.

Figure 9A:
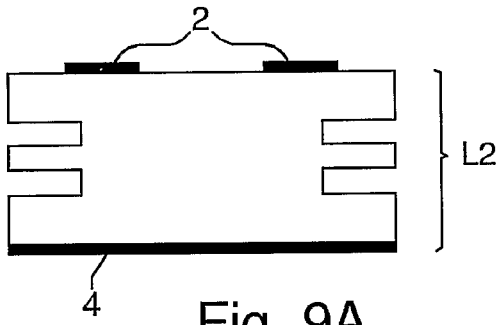
FIGS. 9A-9B show different possible shapes of dielectric substrates.
Figure 9B:
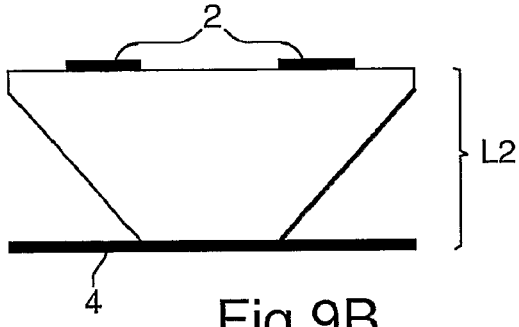

FIGS. 9A-9B show two possible shapes of the first dielectric substrate of the antenna assembly according to the first embodiment as well as the first multi-system antenna assembly. We retrieve dielectric layer L2 arranged between annular patch radiating element 2 and electrically conducting ground plane 4, wherein the opening is not shown.

On FIG. 9A, dielectric layer L2 is globally cylinder-shaped with at least one annular recess arranged at the cylinder periphery.

On FIG. 9B, dielectric layer L2 is frusto-conical shaped, the large base being arranged on the side of annular patch 2 and the small one being arranged on the side of ground plane 4.

Both solutions allow to adjust the dielectric constant of the dielectric layer arranged between the annular patch and the ground plane.

Figure 10A:
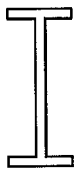
FIGS. 10A-10C show different possible shapes of slots.
Figure 10B:
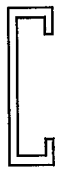
Figure 10C:
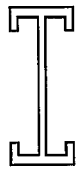
Figure 11:
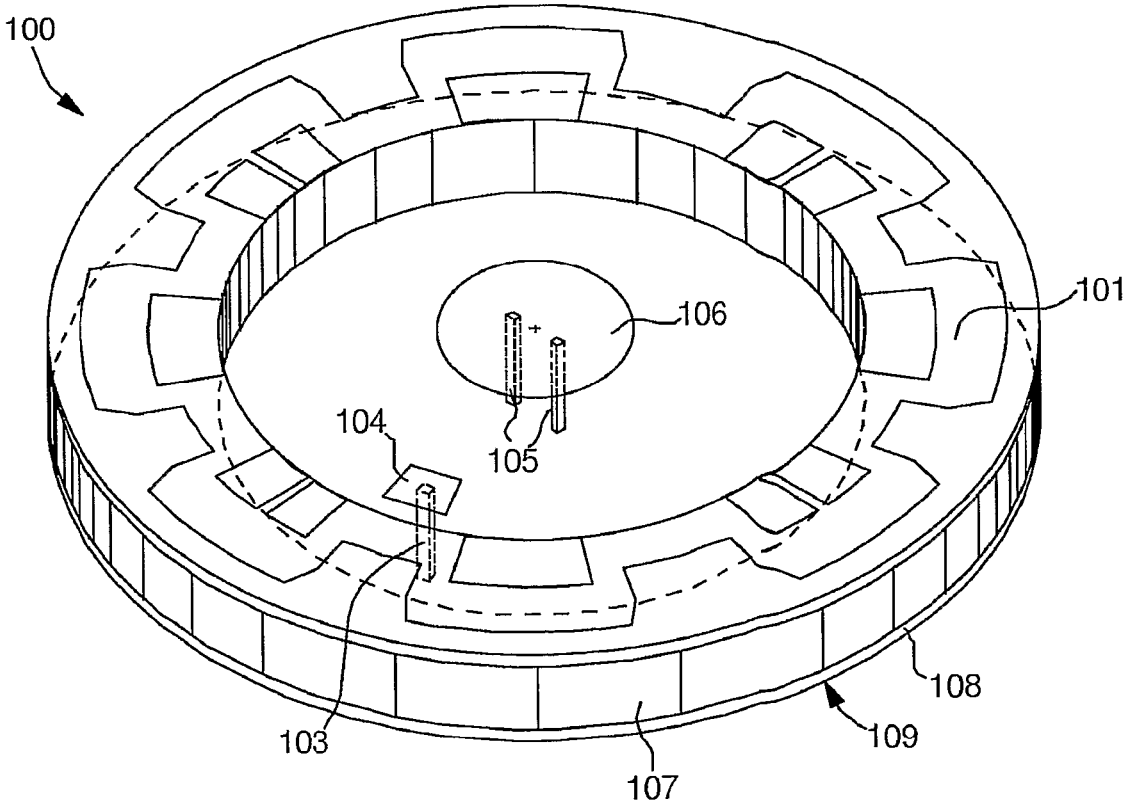
FIG. 11, already described, is a tridimensional view of a two-antenna assembly according to the prior art.

FIGS. 10A-10C show different possible shapes of slots. In order to obtain an optimized slot-coupling between the feeding line and the annular patch, it is very important that the whole surface covered by the slot faces completely the annular patch.

However, as a long slot is required to couple the energy from the microstrip line to the patch radiating element, then the required size for a standard rectangular slot would be too large as regard the width of the annular patch and consequently it would increase the level of coupling between the excitation ports, and thus would decrease the circular polarisation quality. Therefore to avoid this problem some special slots with folded arms have been designed. Each slot is folded up to be fully facing the annular patch radiating element.

For that purpose, FIG. 10A shows a first example of a slot with an overturned H-shape. FIG. 10B shows a second example of a slot which is C shaped. FIG. 10C shows a third example of a slot with a mirrored T-shape.

As final considerations, it is to note that for the same resonant mode, annular patches allow to design smaller antennas with respect to circular patches. In fact in higher order modes circular antennas the field density under the central part of the patch is very low. For this reason, this part of the antenna can be cut out to obtain a ring without affecting the performances of the antenna; the cut portion can then be used for other applications. On the other hand the electrical length of the antenna is increased, hence reducing the resonant frequency of the antenna.

Finally, it is understood that the above described embodiments are merely illustrative of the many possible specific embodiments, which can represent principles of the present invention. Numerous and varied other arrangements can readily be devised in accordance with these principles by those skilled in the art without departing from the scope and spirit of the invention.

What is claimed is:

1. A microstrip patch antenna for mobile satellite communications comprising:

a first electrically conducting ground plane having two slots;

at least one annular patch radiating element having a central axis;

at least one first dielectric layer disposed between the first electrically conducting ground plane and the patch radiating element;

two feed lines slot-coupled to the patch radiating element for providing signal energy in a contactless manner to or from the patch radiating element through the slots; and a second dielectric layer disposed between the feed line and the first electrically conducting ground plane, wherein the antenna further comprises a second ground plane and a third dielectric layer disposed between the second ground plane and the feed line, and wherein the two slots are radially oriented with respect to the central axis and angularly shifted so as to receive both left and right hand circular polarisations.

2. The microstrip patch antenna according to claim 1, wherein said slots are angularly shifted by 135° with regard the central axis.

3. The microstrip patch antenna according to claim 2, wherein each of said slots is folded up to be fully facing said annular patch radiating element, said slot being C or mirrored T-shaped.

4. The microstrip patch antenna according to claim 1, wherein the antenna is substantially cylindrical and wherein the external radius of the radiating element is slightly greater than a quarter of the desired wavelength.

5. The microstrip patch antenna according to claim 1, wherein said first dielectric layer has an annular geometrical cross section defining an inner void region.

6. The microstrip patch antenna according to claim 5, wherein said at least one first dielectric layer is made of at least one plastic layer, and said second dielectric layer is made of PTFE.

7. The microstrip patch antenna according to claim 1, wherein a thin layer of epoxy is disposed between said first dielectric layer and said patch radiating element.

8. The microstrip patch antenna according to claim 1, wherein said first dielectric layer is frusto-conical shaped, having a small and a large bases, said large base being arranged on the side of said patch radiating element and said small base being arranged on the side of said first electrically conducting ground plane.

9. The microstrip antenna according to claim 1, wherein said first dielectric layer is cylindrical-shaped with at least one annular recess arranged at the cylinder periphery.

10. The microstrip patch antenna according to claim 1, wherein at least two dielectric layers are disposed between said first electrically conducting ground plane and said patch radiating element, including at least one plastic layer and one foam layer, and wherein the resulting dielectric constant of these at least two layers is strictly greater than 1 and strictly less than 2.

11. The microstrip patch antenna according to claim 10, wherein three dielectric layers are disposed between said first electrically conducting ground plane and said patch radiating element, including two layers of plastic or epoxy and one layer of foam inserted between said plastic or epoxy layers.

12. The microstrip patch antenna according to claim 10, wherein five dielectric layers are disposed between said first electrically conducting ground plane and said patch radiating element, including three layers of plastic and two layers of foam inserted between said plastic layers.

13. The microstrip patch antenna according to claim 1, wherein the microstrip patch antenna further comprises two extra slots which are arranged symmetrically with respect of the central axis.

14. A multi-system antenna for mobile communications comprising:

a first electrically conducting ground plane having two first slots and one second slot;

an annular patch radiating element and a circular patch radiating element concentrically arranged and coplanar with respect to said annular patch radiating element having a central axis;

at least one first dielectric layer disposed between the electrically conducting ground plane and the annular and circular patch radiating elements;

two first feed lines and one second feed line slot-coupled to the patch radiating clement for providing signal energy in a contactless manner to or from the annular and circular patch radiating elements respectively through the first and second slots; and a second dielectric layer disposed between the first and second feed lines and the first electrically conducting ground plane, wherein the two first slots are radially oriented with respect to the central axis and angularly shifted so as to receive both right and left hand circular polarisations of a first application with the annular patch radiating element.

15. The multi-system antenna according to claim 14, wherein the multi-system antenna further comprises a second ground plane and a third dielectric layer disposed between said second ground plane and said feed lines.

16. The multi-system antenna according to claim 14, wherein two second slots are tangentially oriented and angularly shifted so as to receive left, respectively right, hand circular polarisation of a second, respectively a third, application.

17. A multi-system antenna comprising a microstrip patch antenna according to claim 5, wherein the multi-system antenna further comprises another antenna disposed in said inner void region of said microstrip patch antenna.

18. The multi-system antenna according to claim 17, wherein the multi-system antenna further comprises a third antenna formed by a flexible substrate wrapped around said microstrip patch antenna.

19. The multi-system antenna according to claim 1, wherein the at least one first dielectric layer is disposed between said slots and said patch radiating element.

20. The microstrip patch antenna according to claim 1, wherein each of said slots is folded up to be fully facing said annular patch radiating element, said slot being C or mirrored T-shaped.

21. The microstrip patch antenna according to claim 1, wherein at least two dielectric layers are disposed between said first electrically conducting ground plane and said patch radiating element, including at least one plastic layer and one foam layer, and wherein the resulting dielectric constant of these at least two layers is between 1.7 and 1.9.

22. The multi-system antenna according to claim 14, wherein the at least one first dielectric layer is disposed between the first and second slots and the annular and circular patch radiating elements.

23. The multi-system antenna according to claim 15, wherein two second slots are tangentially oriented and angularly shifted so as to receive left, respectively right, hand circular polarisation of a second, respectively a third, application.

* * * * *